United States Patent [19]

Brolin

[11] Patent Number: 4,624,372

[45] Date of Patent: Nov. 25, 1986

[54] GUN SECURITY APPARATUS

[76] Inventor: Charles A. Brolin, 1100 30th St. SE, Cedar Rapids, Iowa 52403

[21] Appl. No.: 567,841

[22] Filed: Jan. 3, 1984

[51] Int. Cl.[4] ..... A47F 5/08

[52] U.S. Cl. ..... 211/4; 211/64; 70/58

[58] Field of Search ..... 211/4, 64, 87; 70/57, 70/58; 224/315, 912, 913; 42/70 E, 14; 248/201, 203

[56] References Cited

U.S. PATENT DOCUMENTS

| | | | |
|---|---|---|---|
| 2,667,274 | 1/1954 | Diebold . | |
| 2,710,100 | 6/1955 | Vermillion . | |
| 2,958,423 | 11/1960 | Caloiero . | |
| 3,637,180 | 1/1972 | Parry . | |
| 3,767,093 | 10/1973 | Pinkerton et al. | 211/64 X |
| 3,857,491 | 12/1974 | Townsend . | |
| 4,139,100 | 2/1979 | Reed . | |
| 4,182,453 | 1/1980 | Worswick . | |
| 4,198,026 | 4/1980 | Capolupo . | |
| 4,299,045 | 11/1981 | Cervantes . | |
| 4,328,687 | 5/1982 | Ritchie | 70/58 X |
| 4,461,385 | 7/1984 | Clouser | 211/4 |

FOREIGN PATENT DOCUMENTS 2082293A 3/1982 United Kingdom .

*Primary Examiner*—Robert W. Gibson, Jr.
*Attorney, Agent, or Firm*—Allan L. Harms

[57] ABSTRACT

Gun securing apparatus is provided which comprises a base, trigger guard securing pins selectively mounted to said base, having annular grooves or slots upon the length thereof, a locking member insertable in a transverse passageway of said base and intercepting said annular groove or slot of said pin, padlock means securing said locking member and engagement within said annular groove or slot of said pin. An alternative embodiment provides cam locking means which selectively engage the annular groove or slot of said pin member. Another embodiment provides a curved enclosing member having an end insertable with a passgeway of a base, said end having a groove or notch thereupon. Cam lock means selectively engage said notch or groove of said enclosing member effectively preventing removal of said enclosing member from said base. Another embodiment provides electrical monitoring elements to indicate unlocked condition of the cam lock member of the invention or incomplete insertion of the pin or enclosing member in the passageway of the base. Another embodiment provides a fixed circular locking pin member or a curved locking pin member and a movable ring securing member with a partial securing of long guns.

40 Claims, 8 Drawing Figures

FIG 6
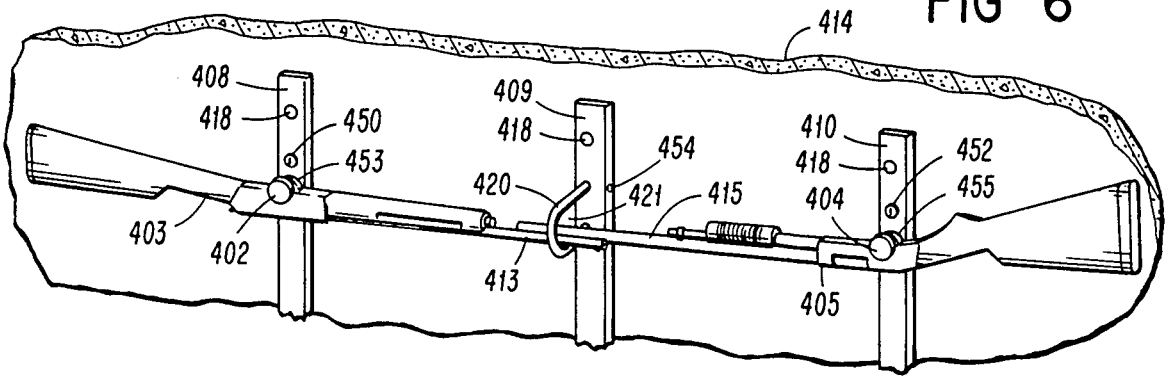
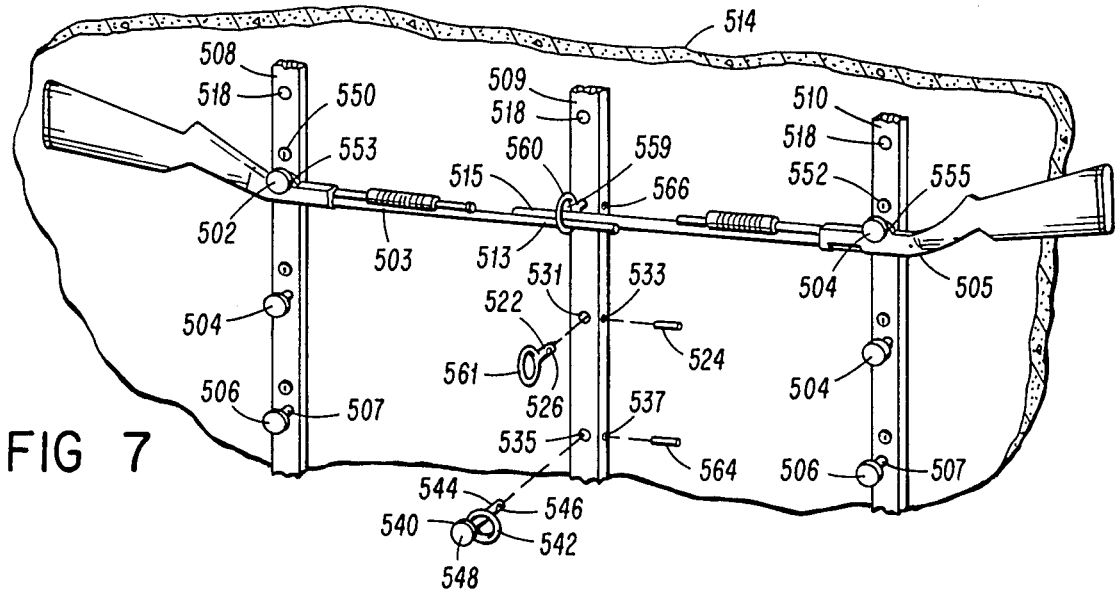
FIG 7
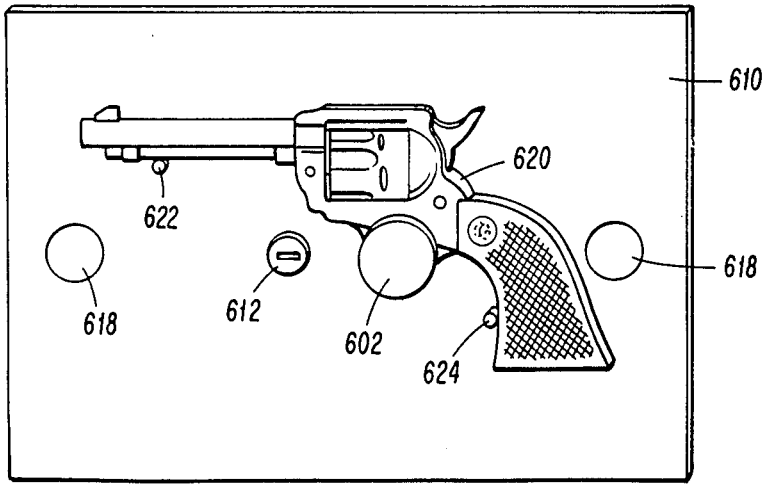
FIG 8

GUN SECURITY APPARATUS

BACKGROUND OF THE INVENTION

This invention relates to systems for firearm security and control.

Firearms, since their earliest origin, have been valuable property. As such, there has always been a risk of loss by theft. Because of the gun's valuable nature, it has been and continues to be a target for theft. Many limited production, custom made, or highly engraved weapons, have price tags in the thousands of dollars. Typical sporting or personal weapons cost in the hundreds. It is not uncommon for a sporting enthusiast to own six or more weapons. Firearm dealers, on the other hand, may have hundreds of weapons in inventory. Security branches of local, state and hational governments own hundreds of weapons of all kinds for protection of the public. All firearm owners have the same problem of how to secure and control the unauthorized access to these firearms.

Previous efforts have been made to solve the problem of providing adequate firearm security. Early attempts included the gun cabinet, which is usually made of wood or a wood substitute, and glass. The glass provides windows in the cabinet doors, so that an owner can see his guns. Often the doors lock with a key, so that access by children is prevented. The gun cabinet is a piece of furniture, but is not much help against thefts, since access to the guns can be easily and quickly accomplished.

Another common security device is a locking gun rack, which is usually made of wood and light duty metal parts. The rack hangs on a wall and accommodates long guns in a horizontal fashion. Various retaining devices are used, which may lock all guns to the rack or individually lock single guns. Often, only one end of the gun is retained to the rack. The shortcomings of such devices include that the attachment is usually light duty and the thief merely has to remove the rack with the guns and later effectuate removal of the guns from the rack.

Security chests or safes made of heavy duty material, which can accommodate both long guns and handguns are satisfactory for security, but they suffer from shortcomings including that the weapons are not on display, the device is bulky, and moisture problems may develop within the enclosure.

Other existing devices include steel cable or chain threaded through the trigger guards of the weapons and padlocked to the gun rack or cabinet.

Alarm systems are also available, which would use an electric wire passed through the gun trigger guard, which if cut or broken triggers an alarm.

The slip-together methods of providing security include broad-ended pins passing through the trigger guard and being detachably fastened to rack devices, or bands or clamping means completely surrounding the stock or barrel of a long gun. Examples of the trigger guard locking pin devices are found in Worswick, U.S. Pat. No. 4,182,453, and Diebold, U.S. Pat. No. 2,667,274. A device utilizing a flat band to surround a gun stock is shown in Townsend, U.S. Pat. No. 3,857,491.

SUMMARY OF THE INVENTION

The instant invention pertains to systems for firearm security and control, and provides for security for either long guns or hand guns in flexible arrangements.

In one embodiment of the invention, said pins pass through the trigger guard of a firearm to be secured and may be of sufficient length to pass through a series of firearm trigger guards. A pair of curved enclosing pin members may be disposed and suitably positioned adjacent base members such that one of said enclosing pin members surrounds the stock of a long gun while the other enclosing pin member surrounds the barrel.

Individually key activated sliding mechanisms are selectively engaged upon the annular grooves or slots of the firearm engaging pins.

In an alternative embodiment, said bases contain a complement of openings positioned within said base members wherein locking pin disposed within said opening will engage the annular grooves or slots of said pins. Said engaging pins comprise elongated bodies having enlarged first ends and second ends containing openings for passage of a padlock therethrough.

Base members are fixedly mounted to a structure, such as a wall, and are equipped with openings into which may be inserted gun-engaging pins, which may be selectively engaged within the base members by control members. Said pins comprise elongated bodies containing enlarged first ends and second ends equipped with slots or annular grooves placed thereupon. Slideably movable locking members are selectively engaged with the slots or annular grooves of the second ends of the pins when said second ends engage the base members. Enclosing pin members have first curved ends and second ends containing annular grooves or slots thereupon. When said second ends of said enclosing pin members fully engage said base members, the curved ends of said enclosing pin members are positioned with said base members to form an entrapment. Said second groove containing ends of said enclosing pin members may be selectively engaged by slideably movable locking members within said base.

Electrical signal monitoring circuitry is associated with removal of said pin locking mechanisms to indicate removal or tampering with individual weapons.

One of the objectives of the invention is to provide individual firearm security.

Another objective is to allow firearms to be displayed to viewers, while being attractively secured.

Another objective is to provide an extremely flexible system where the long guns may be displayed in vertical or horizontal fashion and long guns and hand guns may be intermixed in the display.

Another objective of the invention is to provide a system for securing multiple hand guns with one locking device.

Another objective of the invention is to provide easy exchange of securing devices for hand guns or long guns.

Another objective of the device is to provide for a compact system of gun display and security.

Another objective of the invention is to provide for electronic indicator control of weapons tampered with or removed.

Another objective is to provide individual locking devices for individual firearms secured.

The foregoing objectives and others will be apparent from reference to the detailed description below.

DESCRIPTION OF THE DRAWINGS

FIG. 6 is a perspective view of an alternative embodiment of the system invention showing the securing of two long guns muzzle to muzzle.

FIG. 7 is a perspective view of an alternative embodiment of the invention showing a fixed ring securing member and a sliding ring securing member.

FIG. 8 is a front elevation of the invention securing a single handgun.

DETAILED DESCRIPTION

Figure 1:
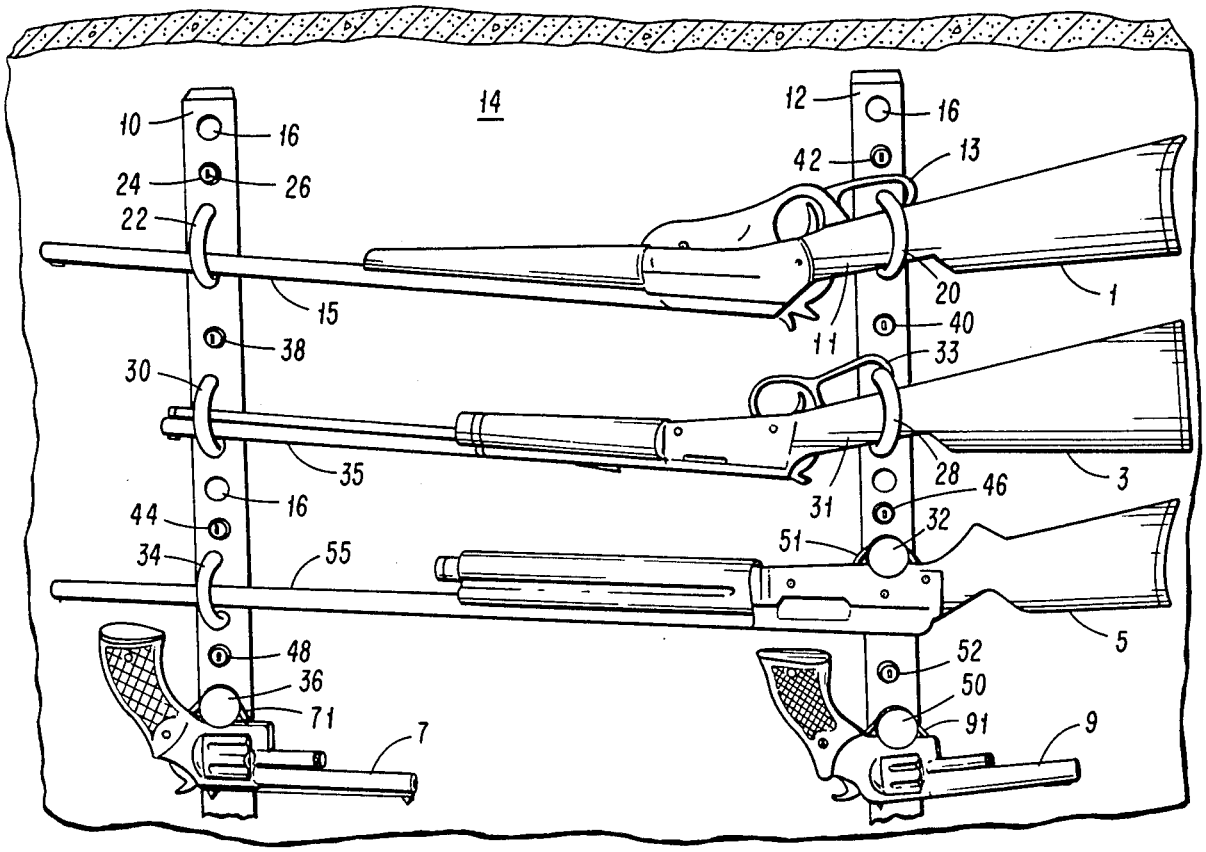
FIG. 1 is a front elevation of a combination of the invention securing long guns and handguns.

Referring to FIG. 1, the system invention is shown securing three long guns 1, 3 and 5, and two handguns 7 and 9. Bases 10 and 12 are fixed to structure 14 by mounting hardware 16. Long gun 1 is a lever-action-type weapon. Enclosing member 20 surrounds stock grip 11 of long gun 1 and passes through the lever 13 of long gun 1 and engages base 12. Enclosing member 22 entraps muzzle 15 of long gun 1 and engages base 10. Key receiving mechanism 24 is equipped with key opening 26 and is associated with enclosing member 22. Key receiving mechanism 42 is associated with enclosing member 20. Lever action long gun 3 is secured to the system invention with enclosing members 28 and 30. Enclosing member 28 surrounds stock 31 of long gun 3 and passes through lever 33 before engaging base 12. Enclosing member 30 entraps muzzle 35 of long gun 3 and engages base 10. Key mechanisms 38 and 40 are associated with enclosing members 30 and 28 respectively. As can be readily seen, long gun 3 could have as easily been oriented such that stock 31 became positioned adjacent base 10 and secured by enclosing member 30 with muzzle 35 adjacent base 12 and entrapped by enclosing member 28.

Long gun 5 has no lever. Pin 32 passes through trigger guard 51 of long gun 5 and engages base 12. Muzzle 55 is entrapped by enclosing member 34 which engages base 10. Key receiving mechanisms 44 and 46 are associated with enclosing member 34 and pin 32 respectively. Handgun 7 is secured to base 10 by pin 36 which passes through trigger guard 71 and engages base 10. Key receiving mechanism 48 on base 10 is associated with pin 36. Handgun 9 is secured to base 12 by pin 50 which passes through trigger guard 91. Key mechanism 52 is associated with pin 50.

Figure 2:
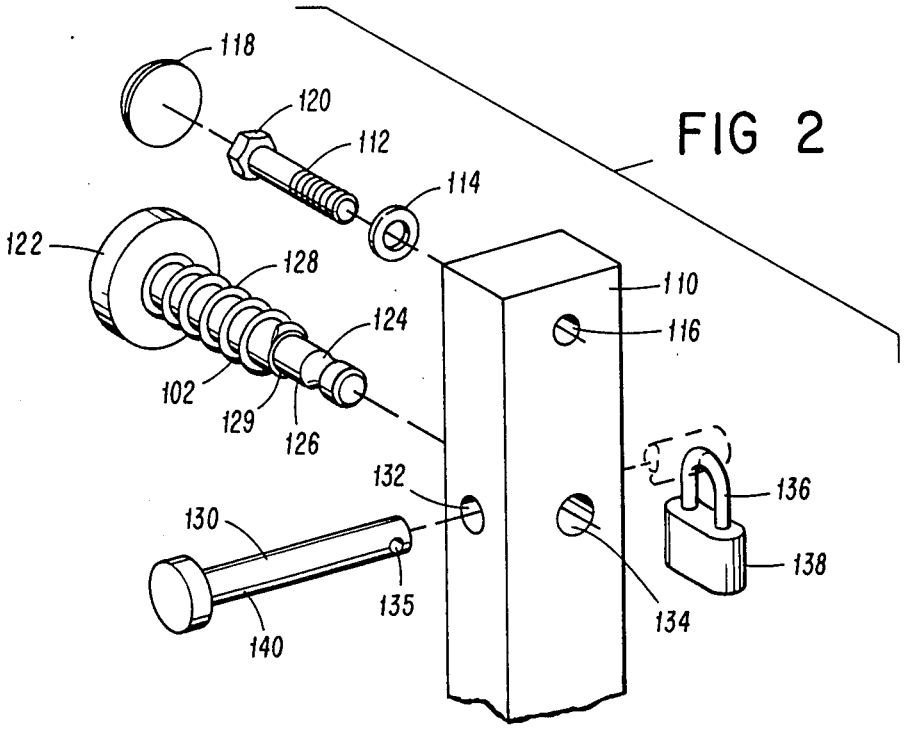
FIG. 2 is an exploded view in perspective of a trigger guard securing embodiment of the invention.

Detail of the engaging mechanism of pin 102 with base 110 can be seen in the embodiment disclosed in FIG. 2. In this embodiment base 110 is seen from a rear perspective. Bolt 112 and washer 114 are installed through opening 116 for installation of base 110 to a wall or other structure. Expansion plug 118 is installed in base 110 such that head 120 of bolt 112 is not accessible after installation. Pin 102 is elongated and is equipped with enlarged end 122 on one end, and annular groove 124 formed in its opposing end 126. Shoulder 129 is formed by reduction in diameter of pin 102 at opposing end 126. Only opposing end 126 is of appropriate size to enter first passageway 134. Sleeve 128 is employed generally along pin 102 between enlarged end 122 and with opposing end 126 and is intended to cushion the abutment of gun parts to pin 102. Pin 102 is available to engage first passageway 134. Locking member 130 is provided to pass through intersecting passageway 132 in base 110. Transverse opening 135 is provided in locking member 130 for engagement of shackle 136 of padlock 138 therewith after passage of locking member 130 into intersecting passageway 132. First passageway 134 and intersecting passageway 132 intersect within base 110 such that elongated body 140 of locking member 130 engages annular groove 124 of pin 102 when opposing end 126 of pin 102 is inserted in first passageway 134. It is obvious that opposing end 126 must be inserted in base 110 before locking member 130 is inserted in intersecting passageway 132. The engagement of shaft 140 of locking member 130 with annular groove 124 of pin 102 prevents withdrawal of pin 102 from its engagement in first passageway 134 of base 110. When locked, shackle 136 of padlock 138 prevents removal of locking member 130 from base 110 which thereby prevents removal of pin 102 from base 110.

Figure 3:
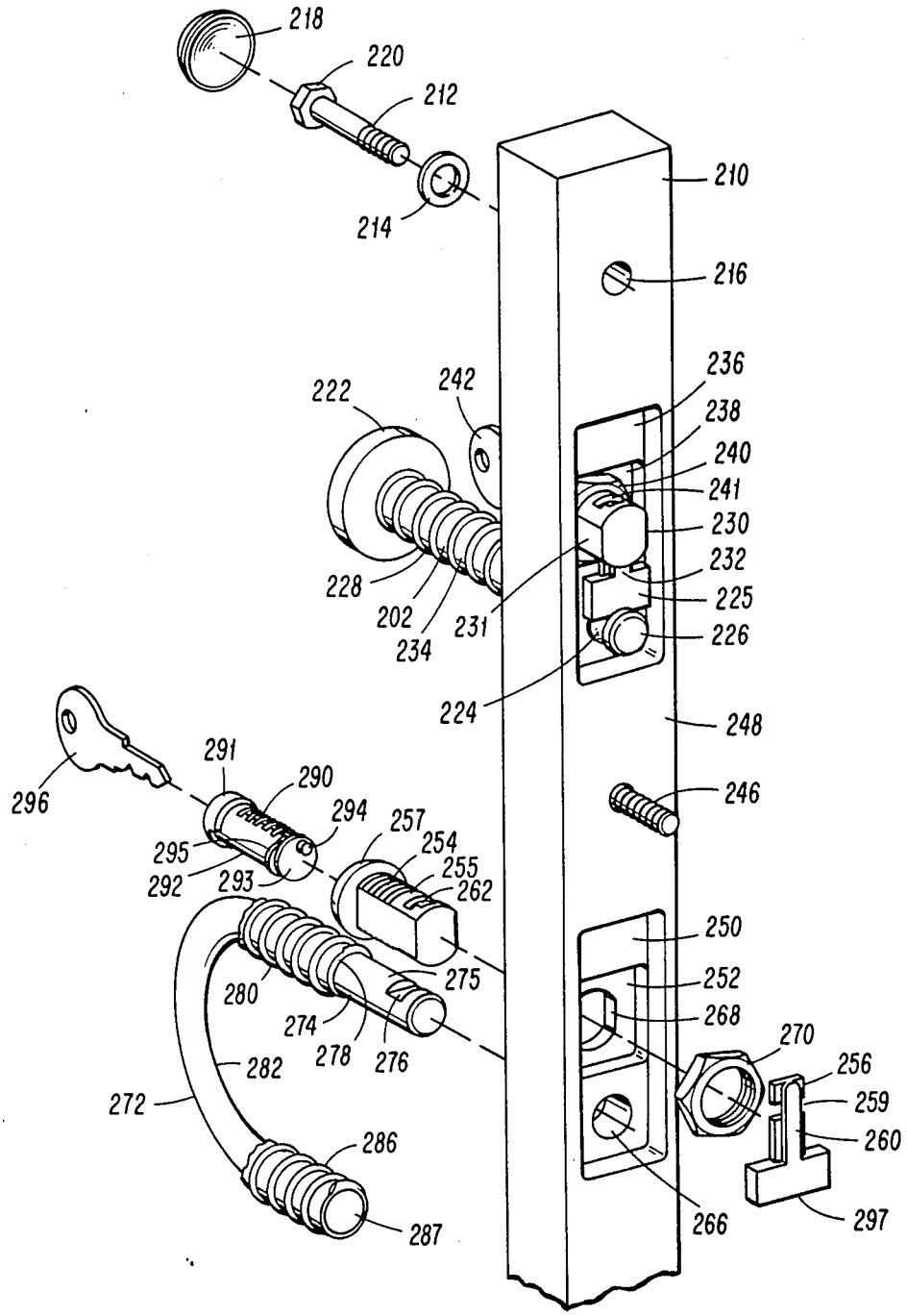
FIG. 3 is a partially exploded view in perspective of an alternative embodiment of the invention showing a trigger guard securing pin and a muzzle or gun stock enclosing member.

Referring now to FIG. 3, an alternative embodiment of the invention is shown. Base 210 is shown in perspective from the rear. Bolt 212 passes through washer 214 and opening 216 to engage the wall or other structure to which base 210 is mounted. Expansion plug 218 is placed over bolt 212 and serves to preclude access to head 220 of bolt 212 after installation of base 210 to a wall or other structure is effectuated. Pin 202 is shown engaged by sliding member 225 at annular groove 224 on opposing end 226. Pin 202 can therefore freely turn on its axis and still remain secure to base 210. Alternatively, pin 202 may be equipped with a slot such as slot 276 of enclosing member 272, in place of annular groove 224. Lock assembly 230 contains opening 241 into which passes sliding member 225 at protusion 232 which extends into opening 241. Sliding member 225 is selectively maintained in position engaging annular groove 224 of pin 202 by action of lock mechanism 231. Sleeve 228 encloses body 234 of pin 202. Enlarged end 222 is of size sufficient to exceed the size of opening of a trigger guard of a weapon. Recess 236 is provided in rear face 248 of base 210 to provide space to actuate sliding member 225 and to accommodate lock assembly 230. Indentation 238 is provided within recess 236 to accept fastener 240 for lock mechanism 231. Key 242 engages lock mechanism 231 from the front of base 210.

Mounting bolt 246 extends from rear face 248 of base 210 to mount to the wall or other structure to which base 210 would be mounted.

Recess 250 is formed in rear face 248 of base 210. Indentation 252 is formed within recess 250. Opening 268, having a non-circular cross sectional shape, passes through base 210 and communicates with indentation 252. Recess 250 and indentation 252 may be of equivalent configuration to recess 236 and indentation 238, respectively. Recess 250 may extend the length of base 210 if desired. Lock mechanism housing 255 is similar in cross sectional shape to opening 268. Lock mechanism housing 255 contains threaded portion 254, head 257, and opening 262. When installed in base 210, lock mechanism housing 255 extends through opening 268 and threaded portion 254 thereof is received by nut 270 which maintains lock mechanism housing 255 to base 210. Indentation 252 and recess 250 are of sufficient depth such that when installed in base 210, lock mechanism housing 255 does not intersect the plane of rear face 248 of base 210 and does not contact the wall or other structure to which base 210 may be mounted. Enclosing member 272 is curved and is approximately the shape of the letter J. Enclosing member 272 has a substantially linear first end 274 and a substantially linear free end 286, interconnected by curved body 282. First end 274 terminates in coaxial extension 275 which is of smaller diameter than the remainder of first end 274 of enclosing member 272 such that extension 275 may enter passageway 266 while shoulder 278 abuts base 210. When installed in base 210, termination 287 of free end 286 of enclosing member 272 almost touches base 210. Slot 276 is formed in extension 275 of first end 274 of enclosing member 272. When J-shaped enclosing member 272 is engaged in base 210 by the insertion of first end 274 into passageway 266, slot 276 is available to receive sliding member 260 which serves to lock enclosing member 272 to base 210, as well as to prevent rotation of enclosing member 272. Enclosing member 272 is equipped with sheath 280 along its entire length except for extension 275. Sheath 280 is of resilient material, such as foam rubber or poly vinyl chloride.

As can be readily understood, pin 202 can be made sufficiently elongate to secure more than one gun with the pin passing through the trigger guard of each gun. Similarly, enclosing member 272 may be equipped with first end 274 and free end 286 of sufficient length to accommodate enclosure of multiple gun muzzles or stocks.

Pin 202 can be interchanged with enclosing member 272 in passageway 266. The invention contemplates any combination of pin 202 and enclosing member 272 as desired by the user. When lock mechanism housing 255 is assembled in base 210, extension 256 of sliding member 260 is inserted into opening 262 of lock mechanism housing 255 from the direction of passageway 266 with respect to opening 268. Slot 259 is provided along extension 256 on the side of extension 256 directed to opening 268.

Lock cylinder 290 is elongate with a key-receiving end 291 and a second end 292. The face 293 of second end 292 is provided with protrusion 294 at its edge. Retaining clip 295 is provided upon second end 292 of key cylinder 290. Key 296 may be inserted in key-receiving end 291 of lock cylinder 290. As is well known in the art, when the proper key 296 is inserted in key cylinder 290, lock cylinder 290 may be rotated in the direction of key rotation.

The rotation of lock cylinder 290 causes the movement of protrusion 294 with respect to the lock mechanism housing 255. When lock cylinder 290 is installed in lock mechanism housing 255, protrusion 294 engages slot 259 of extension 256 of sliding member 260. The rotation of lock cylinder 290 effectuates sliding movement of sliding member 260 through the spacial repositioning of protrusion 294 occasioned thereby. Cylinder 290 is shown oriented such that protrusion 294 is spaced most distant from passageway 266. In this position, when assembled into lock mechanism housing 255, lock cylinder 290 would effectuate displacement of sliding member 260 at its maximal distance from extension 275 of enclosing member 272. When lock cylinder 290 is rotated by 180 degrees, it can be seen that protrusion 294 will be positioned in the opposite configuration from that shown in the drawing, and protrusion 294 will cause sliding movement of sliding member 260 toward extension 275 of enclosing member 272, thus providing engagement of edge 297 of sliding member 260, in slot 276 of enclosing member 272. This engagement of sliding member 260 with slot 276 prevents the rotation of enclosing member 272 around its first end 274. As can be seen, the selective positioning of lock cylinder 290 by use of key 296 effects selective entrapment of enclosing member 272 to bar 210.

Figure 4:
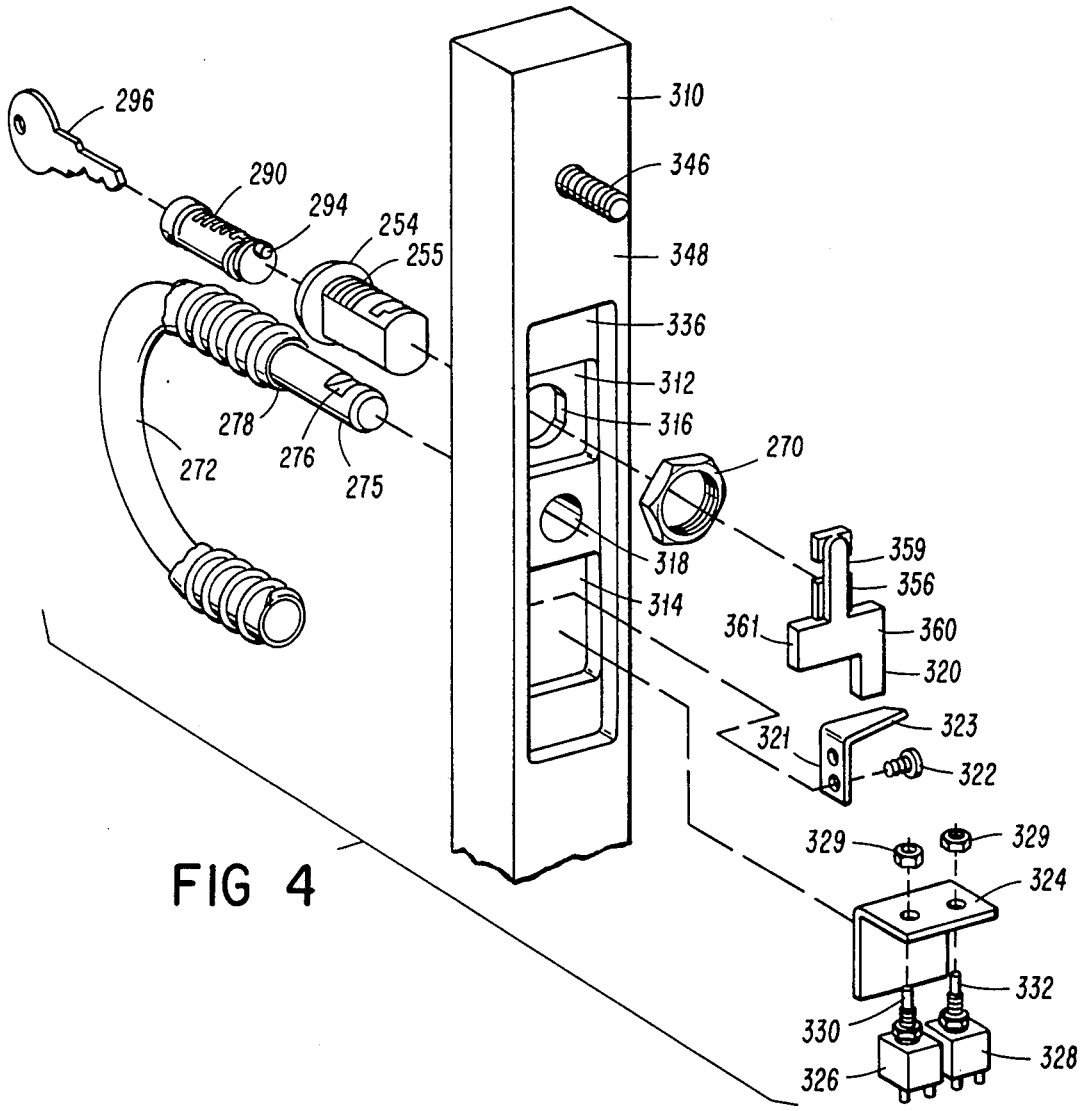
FIG. 4 is an exploded view in perspective of another embodiment of the invention employing electrical monitoring components.

Another embodiment of the invention is shown in FIG. 4. Parts shown in this figure which are identical to those shown in FIG. 3 will carry identical numbers. Base 310 is equipped for electrical monitoring. Recess 336 is provided in rear face 348 of base 310. It is intended that base 310 will be mounted to an immovable structure by bolt 346 such that rear face 348 abuts such immovable structure. Recess 336 may extend the length of base 310. Within recess 336 are indentations 312 and 314. Non-circular passageway 316 is provided to receive lock mechanism housing 255. Passageway 316 communicates with indentation 312. Nut 270 engages threaded portion 254 of lock mechanism housing 255. Passageway 318 passes through base 310 and communicates with recess 336. Passageway 318 is provided to receive extension 275 of enclosing member 272. Extension 275 extends from shoulder 278 and is of appropriate length such that when inserted in passageway 318, shoulder 278 abuts base 310 and extension 275 does not intersect the plane of rear face 348 of base 310. Sliding member 360 is provided with extension 356 on which is provided slot 359. Extending from central portion 361 of sliding member 360 in opposing direction to extension 356 is arm 320. Spring member 321 is mounted by screw 322 within recess 336 such that arm 323 of spring member 321 deflects upon the full insertion of extension 275 of enclosing member 272 into passageway 318 to the extent that shoulder 278 abuts base member 310. Bracket 324 has normally closed switches 326 and 328 affixed thereto by fasteners 329, and is mounted securely within indentation 314. Arm 323 of spring member 321 rests near upon plunger 330 of switch 326 in its relaxed state. When extension 275 of enclosing member 272 is fully positioned within passageway 318, extension 275 engages arm 323 of spring member 321 thereby deflecting said spring member toward switch 326, thereby depressing plunger 330 of switch 326 and causing switch 326 to open. Arm 320 of sliding member 360 rests above plunger 332 of switch 328 so long as lock cylinder 290 is positioned with protrusion 294 at its position most distant from passageway 318. When lock cylinder 290 is rotated by key 296, protrusion 294 which engages slot 359 of extension 356 of sliding member 360, forces sliding member 360 downward and causes arm 320 of sliding member 360 to engage and depress plunger 332 of switch 328. It is understood that alternative actuation of switch means may be employed and are contemplated by the invention.

Figure 5:
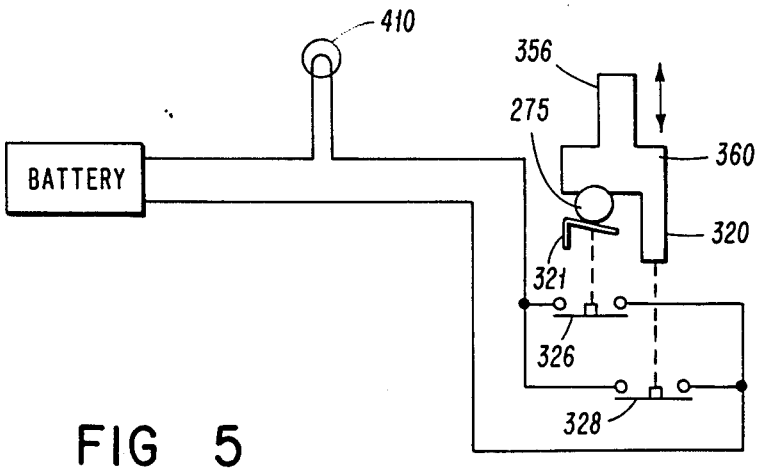
FIG. 5 is a schematic of the electric monitoring circuit of FIG. 4.

In FIG. 5, a schematic of the electrical circuitry is shown. Suitable wiring is disclosed to connect a power source labelled as a battery, bulb 410 and switches 326 and 328. Sliding member 360 is shown positioned to engage extension 275. Extension 275 deflects arm 323 of spring member 321 causing switch 326 to be depressed and therefore be in its open state. Arm 320 of sliding member 360 also depresses switch 328 into open status. As can be readily seen, when sliding member 360 is moved away from extension 275, arm 320 will deactuate switch 328 allowing it to close and energize bulb 410. When extension 275 is removed from base 210, arm 323 of spring member 321 will return to undeflected position, thereby relaxing switch 326 and allowing it to return to its normally closed position, thus providing an alternative path of energization for bulb 410. Equivalent forms of wiring, signalization and supply of power are contemplated by this invention. It can readily be seen that if extension 275 is removed from base 310 or is not fully inserted into passageway 318, arm 323 of spring member 321 will not be deflected and will allow switch 326 to close energizing bulb 410 regardless whether arm 320 of sliding member 360 is in its downward position depressing switch 328 and causing it to be open. Monitoring is therefore available to indicate if lock cylinder 290 is in the unlocked position or to detect if enclosing member 272 is not fully inserted in passageway 318. Bulb 410 may be substituted with or may accompany other monitoring or measurement devices which are energized or selectively controlled upon the closing of either switch 326 or 328. For example, a recording mechanism could be used to collect data regarding removal or unlocking of any of the securing members associated with the system of this invention.

A further alternative embodiment of the invention is disclosed in FIG. 6. Three bases 408, 409, and 410 are mounted to a wall 414, by hardware enclosed by expansion plugs 418. Bases 408, 409 and 410 may be substantially identical. Long guns 403 and 405 are secured to bases 408, 409 and 410. Pins 402 and 404 secure trigger guard 453 of long gun 403 and trigger guard 455 of long gun 405 respectively. Pins 402 and 404 may be substantially identical. Muzzle 413 of long gun 403 and muzzle 415 of long gun 405 each extend into enclosed space 421 created by enclosing member 420 and base 409. Lock mechanism 450 selectively controls removal of pin 402 from base 408 and lock mechanism 452 selectively controls removal of pin 404 from base 410. Retaining pin 454 is installed transversely in base 409 preventing removal of enclosing member 420 which is equipped with a notch such as notch 526 of enclosed member 561 shown in FIG. 7.

FIG. 7 provides another alternative embodiment of the invention. Bases 508, 509 and 510 are mounted to immovable structure 514 by fastners 518. Lock mechanisms 550 and 552 selectively control pins 502 and 504 respectively, which secure the trigger guards 553 and 555 of guns 503 and 505 to bases 508 and 510, respectively.

Enclosed member 560 is shown fixed to base 509 by holding pin 566. Insertion of shaft 522 of enclosed member 561 into opening 531 of base 509 is intended. Transverse notch 526 is provided on shaft 522 and is engaged by holding pin 524 when holding pin 524 is driven into transverse passageway 533 of base 509. Transverse notch 526 may be substituted with a transverse aperture which similarly may be engaged by holding pin 524.

Opening 559 of enclosed member 560 receives muzzles 513 and 515 of guns 503 and 505 respectively. Additional pins 504 are installed in bases 508 and 510 but are not in use to secure guns. Pins 506 are also not in use but are featured with shanks 507 which are sufficiently elongated to pass through one or more weapons' trigger guards and insert into bases 508 and 510. Pin 540 is provided with ring 542 which surrounds shank 544 of pin 540 but may be removed when pin 540 is detached from base 509. Shank 544 is provided with transverse notch 546. Ring 542 is not sufficiently large to pass over head 548 of pin 550 when a gun's muzzle is inserted within ring 542. When shank 544 is inserted into opening 535 of base 509, a holding pin 564 may be driven into transverse passageway 537, wherein it engages notch 546 of shank 544. Transverse notch 546 may be substituted with a transverse aperture which similarly may be engaged by holding pin 564. It is intended that the muzzle of a long gun may be inserted through ring 542 and the stock of said long gun then be placed adjacent base 508 or base 510 and secured through its trigger guard by one of pins 506 to base 508 or 510.

In FIG. 8, an additional alternative embodiment of the invention is shown. Expansion plugs 618 cover mounting hardware used to secure base 610 to a wall or other structural component or other substantially immovable object. Lock mechanism 612 is associated with pin 602 which secures handgun 620 to base 610. Supports 622 and 624 provide stops to hold handgun 620 in an upright position.

Throughout this specification, it is to be understood that bases 10, 12, 210, 310, 408, 409, 410, 508 and 510 may be fully interchangeable. Furthermore, pins 102, 202, 402, 404, 502, 504 and 540, enclosing members 272, 420, enclosed members 506 and 561 may be constructed to be interchangeably insertable within passageway 266 of base 210 as shown in FIG. 3 or in passageway 134 of base 110 shown in FIG. 2 or in passageway 318 of base 310 of FIG. 4. Furthermore, it is to be understood that enclosing members 272 and 420 may likewise be interchangeably inserted within passageway 134 of base 110 or passageway 266 of base 210 and secured either by a sliding member such as sliding member 260 of FIG. 3, 360 of FIG. 4 or by locking member 130 of FIG. 2.

Having thus described the invention, I claim:

1. Apparatus to secure guns, the invention comprising
a base,
an elongated pin engageable to said base,
a locking member engageable with said pin,
said base having a front face and a rear face,
said base being permanently attachable to a substantially immovable structure at its rear face,
said front face having an elongated opening therewithin,
said elongated opening having an axis substantially non-parallel to the front face of said base,
said elongated pin having a first end, a central body and a second end,
said elongated pin capturingly embracing said gun along the first end and central body of said pin,
said second end of said pin being insertable into said elongated opening of said base,
said body of said pin containing a transverse groove thereon adjacent the second end of said pin
said locking member selectively engaging said transverse groove of said elongated pin,
said locking member lockably positioned in engagement with said transverse groove of said pin
said base having a recess within the rear face thereof,
said base having an indentation within the recess of said rear face,
said elongated opening communicating with said recess outside said indentation in said recess,
said locking member housed within said indentation.

2. The invention of claim 1 wherein said base is provided with a hole therethrough from its front face to its rear face, said hole being counterbored upon the front face of said base, a fastening bolt having a head and a shank is insertable in said hole, said shank of said bolt being of sufficient length to pass through said hole and penetrate said immovable structure to fasten said base to said structure, said counterbore of said hole being sufficiently deep to receive the head of said bolt, an expansion plug is forcibly insertable within said counterbore to enclose the head of said bolt within said base.

3. The invention of claim 1 wherein said body of said pin has a first larger diameter portion adjacent said enlarged end and a second smaller diameter portion adjacent said second end, said body has a shoulder between said first larger diameter portion and said second smaller diameter portion, said shoulder of said body abuts said face of said base, said second smaller diameter portion extends into said opening in said face of said base, said transverse groove of said body is contained upon said second smaller diameter portion of said body.

4. The invention of claim 1 wherein said groove on said pin is an annular groove.

5. Apparatus to secure guns having trigger guards, the invention comprising a base, an elongated pin engageable to said base, a locking mechanism engageable with said pin, said base having a front face and a rear face, said base being permanently mountable to a substantially immovable structure at its rear face, said base having a recess within its rear face, said rear face having an indentation within the recess thereof, said front face having a first passageway therein, said first passageway communicating with said recess, said base having a second passageway through said base from the front face thereof and communicating with said indentation within said recess, said first passageway having an axis substantially non-parallel to the front face of said base, said elongated pin having an enlarged end, a central body and a second end, said enlarged end being larger than the opening of the trigger guard of the gun or guns to be secured, said second end of said pin being insertable through said trigger guard and into said first passageway, said body of said pin containing a transverse groove thereon adjacent the second end of said pin said locking mechanism mounted within said second passageway selectively engaging said groove of said pin.

6. The invention of claim 5 wherein said locking mechanism is a cam lock mechanism.

7. The invention of claim 5 wherein a plurality of said bases are permanently mountable to said immovable structure with spacing therebetween, said spacing is less than the distance between the muzzle end and the trigger guard of said gun to be secured, one or more enclosing members are engageable to said bases within said first passageway of said bases, one locking mechanism is engageable with each of said enclosing members, each of said enclosing members having a first end, a central curved portion and a free end, said free end and said first end being substantially parallel to each other, said free end and said first end spaced apart sufficiently to accommodate the muzzle of a gun therebetween, said first end of said enclosing members being insertable in said first passageway, said first end of each of said enclosing members containing a transverse groove thereon said enclosing members and said bases each forming a gun muzzle receiving enclosure when said first ends of said enclosing members are inserted in said first passageways, each of said locking mechanisms is a cam lock mechanism mounted within each of said second passageways selectively engaging said grooves of each of said first ends of said enclosing members.

8. The invention of claim 5 wherein a plurality of said bases are permanently mountable to said immovable structure with spacing therebetween, said spacing is less than the distance between the muzzle end and the trigger guard of said gun to be secured, a plurality of said elongated pins are engageable to said bases within said first passageway of said bases, one locking mechanism is engageable with each of said pins, a circumferentially enclosed member is selectively placed upon the central body of at least one of said pins, said circumferentially enclosed member encloses an enclosure, said enclosure of said circumferentially enclosed member being capable of receiving the muzzle of said long gun, said enclosure of said circumferentially enclosed member being insufficient in size to pass over the enlarged end of said at least one pin when a gun muzzle is received within said enclosure.

9. The invention of claim 5 wherein said pin is sufficiently long to be insertable through the trigger guards of more than one gun.

10. The invention of claim 5 wherein said cam lock mechanism comprises a key operated lock mechanism, a sliding member selectively positioned by said key operated lock mechanism, said sliding member selectively engaging said groove of said pin.

11. The invention of claim 5 wherein said cam lock mechanism comprises a lock cylinder housing having a opening therethrough, a sliding member having a first end and a second end, said sliding member slidably inserted within said slot along the first end of said sliding member, a lock cylinder removably inserted within said lock mechanism housing and selectably rotatable therein upon operation by key means, said lock cylinder having a protrusion upon its end received within said housing, said protrusion being mounted upon the edge of said end of said lock cylinder, said sliding member having a transverse groove upon its first end, said protrusion of said lock cylinder engaging said transverse groove of said sliding member, said protrusion effecting sliding displacement of said sliding member upon selective rotation of said lock cylinder, the second end of said sliding member selectively engaging said transverse groove of said first end of said elongated pin when said lock cylinder is rotated, said sliding member having an extension depending from its second end, said extension of said sliding member being engageable with a first normally closed electrical switch, an electrical circuit interconnecting said first switch to an electrical power source and to an electrically operated indicator, said extension of said sliding member selectively actuating said first switch when said lock cylinder is rotated, thereby opening said circuit and deenergizing said indicator.

12. The invention of claim 5 wherein said cam lock mechanism comprises a lock cylinder housing having a slot therethrough, a sliding member having a first end and a second end, said sliding member slidably inserted within said slot along the first end of said sliding member, a lock cylinder removably inserted within said lock mechanism housing and selectably rotatable therein upon operation by key means, said lock cylinder having a protrusion upon its end received within said housing, said protrusion being mounted upon the edge of said end of said lock cylinder, said sliding member having a transverse groove upon its first end, said protrusion of said lock cylinder engaging said transverse groove of said sliding member, said protrusion effecting sliding displacement of said sliding member upon selective rotation of said lock cylinder, the second end of said sliding member selectively engaging said transverse groove of said first end of said elongated pin when said lock cylinder is rotated, said first end of said elongated pin being engageable with a first normally closed electrical switch, an electrical circuit interconnecting said first switch to an electrical power source and to an electrically operated indicator, said first end of said elongated pin selectively actuating said first switch when said elongated pin is inserted in said base sufficiently to be engaged by said sliding member, thereby opening said circuit and deenergizing said indicator.

13. The invention of claim 11 wherein said first end of said elongated pin being engageable with a second normally closed electrical switch, an electrical circuit interconnecting said second switch to said electrical power source and to said electrically operated indicator, said first end of said elongated pin selectively actuating said second switch when said elongated pin is inserted in said base sufficiently to be engaged by said sliding member, thereby opening said circuit and deenergizing said indicator.

14. The invention of claim 5 wherein said groove on said pin is an annular groove.

15. The invention of claim 5 wherein said base is provided with a hole therethrough from its front face to its rear face, said hole being counterbored upon the front face of said base, a fastening bolt having a head and a shank, said shank being of sufficient length to pass through said hole and penetrate said immovable structure to fasten said base to said structure, said counterbore being sufficiently deep to receive the head of said bolt, an expansion plug forcibly insertable within said counterbore to enclose the head of said bolt within said base.

16. The invention of claim 5 wherein said base is an elongated bar said recess is an elongated channel along the length of said elongated bar.

17. The invention of claim 5 wherein said body of said pin has a first larger diameter portion adjacent said enlarged end and a second smaller diameter portion adjacent said second end, said body has a shoulder between said first larger diameter portion and said second smaller diameter portion, said shoulder of said body abuts said face of said base, said second smaller diameter portion extends into said opening in said face of said base, said groove of said body is contained upon said second smaller diameter portion of said body.

18. Apparatus to secure long guns, the invention comprising a base, an enclosing member engageable to said base, a locking mechanism engageable with said enclosing member, said base having a front face and a rear face, said base being permanently mountable to a substantially immovable structure at its rear face, said base having a recess within its rear face, said rear face having an indentation within the recess thereof, said front face having a first passageway therein, said first passageway communicating with said recess, said base having a second passageway through said base from the front face thereof and communicating with said indentation within said recess, said enclosing member having a first end, a central curved portion and a free end, said free end and said first end being substantially parallel to each other, said free end and said first end spaced apart barely sufficiently to accommodate the grip portion of a gunstock therebetween, said first end of said enclosing member being insertable in said first passageway, said first end of said enclosing member containing a transverse groove thereon, said enclosing member and said base forming a gun grip or muzzle receiving enclosure when said first end of said enclosing member is inserted in said first passageway, said locking mechanism is a cam lock mechanism mounted within said second passageway selectively engaging said transverse groove of said first end of said enclosing member.

19. The invention of claim 18 wherein said transverse groove of said enclosing member is an annular groove.

20. The invention of claim 18 wherein said base is mountable to said immovable structure by bolt means passing through a hole in said base, said hole being counterbored to receive the head of said bolt, an expansion plug is installed within said counterbored hole covering said head of said bolt.

21. The invention of claim 18 wherein said first end of said enclosing member has a coaxial extension thereon, said extension having a diameter smaller than said first end, said enclosing member having a shoulder between said first end and said second extension, said extension containing a notch thereon, said extension of said enclosing member selectively insertable within said first passageway of said base, said shoulder abutting the front face of said base when said extension of said first end of said enclosing member is inserted within said passageway, said cam lock mechanism selectively engaging said notch of said extension of said first end of said enclosing member.

22. The invention of claim 18 wherein said cam lock mechanism being engageable with a first normally closed electrical switch, an electrical circuit interconnecting said first switch to an electrical power source and to an electrically operated indicator, said cam lock mechanism selectively actuating said first switch when said cam lock mechanism engages said transverse groove of said enclosing member, thereby opening said circuit and deenergizing said indicator.

23. The invention of claim 18 wherein said cam lock mechanism comprises a lock cylinder housing having a slot therethrough, a sliding member having a first end and a second end, said sliding member slidably inserted within said slot along the first end of said sliding member, a lock cylinder removably inserted within said lock mechanism housing and selectably rotatable therein upon operation by key means, said lock cylinder having a protrusion upon its end received within said housing, said protrusion being mounted upon the edge of said end of said lock cylinder, said sliding member having a transverse groove upon its first end, said protrusion of said lock cylinder engaging said transverse groove of said sliding member, said protrusion effecting sliding displacement of said sliding member upon selective rotation of said lock cylinder, the second end of said sliding member selectively engaging said transverse groove of said first end of said enclosing member when said lock cylinder is rotated, said sliding member having an extension depending from its second end, said extension of said sliding member being engageable with a first normally closed electrical switch, an electrical circuit interconnecting said first switch to an electrical power source and to an electrically operated indicator, said extension of said sliding member selectively actuating said first switch when said lock cylinder is rotated, thereby opening said circuit and deenergizing said indicator.

24. The invention of claim 18 wherein said first end of said enclosing member being engageable with a first normally closed electrical switch, an electrical circuit interconnecting said first switch to an electrical power source and to an electrically operated indicator, said first end of said enclosing member selectively actuating said first switch when said enclosing member is inserted in said base sufficiently to be engaged by said sliding member, thereby opening said circuit and deenergizing said indicator.

25. The invention of claim 22 wherein said first end of said enclosing member being engageable with a second normally closed electrical switch, an electrical circuit interconnecting said second switch to said electrical power source and to said electrically operated indicator, said first end of said enclosing member selectively actuating said second switch when said enclosing member is inserted in said base sufficiently to be engaged by said sliding member, thereby opening said circuit and deenergizing said indicator.

26. Apparatus to secure long guns having stocks and muzzles, the invention comprising a pair of bases each having a front and a rear face, said bases permanently mountable at the rear faces thereof to a substantially immovable structure, said bases mounted with spacing therebetween, said spacing being less than the distance from gun grip to muzzle end of said long guns, said front faces of said bases having a first passageway therein, one securing member engageable with each of said bases, a locking member engageable with each of said securing members, for locking said securing members to said bases, a first of said bases having a recess within the rear face thereof, said rear face having an indentation within said recess, said first passageway of said first base communicating with said recess, said first base having a second passageway through said base from its front face and communicating with said indentation within said recess, each of said securing members having a first end, a central body, and a second end, said body of said securing members having a transverse slot thereon adjacent said second end, said second end of each of said securing members being insertable within said first passageway of said bases, a first of said securing members being selectively removable from said first passageway of said first base, a first of said locking members engageable with said first base comprising a cam lock mechanism mounted within said second passageway of said first base and selectively engaging said transverse slot of said first securing member, a second of said bases having a transverse opening therein communicating with said first passageway of said base, said transverse opening having an axis substantially perpendicular to the axis of said first passageway of said second base, a second securing member being engageable with said second base, a second of said locking members comprising a locking element interferingly insertable within said transverse opening and engageable with said groove of said transverse slot of said second securing member, said second of said securing members receives the muzzle of said gun, said first of said securing members selectively retains the non-muzzle portion of said gun to said first base.

27. The invention of claim 26 wherein said first ends and said bodies of said securing members are covered with resilient material.

28. The invention of claim 26 wherein the transverse slot of said second securing member is a transverse opening therethrough.

29. The invention of claim 26 wherein said transverse slot of said securing members is an annular groove.

30. The invention of claim 26 wherein said guns to be secured have fixed trigger guards thereon, the first of said securing members is an elongated pin, said first end of said elongated pin is an enlarged end being larger than the opening of said trigger guards of the gun or guns to be secured, said second end of said pin being insertable through said trigger guard and into said first passageway of said first base.

31. The invention of claim 26 wherein said first end of said second of said securing members defines a gun muzzle receiving enclosure.

32. The invention of claim 26 wherein said transverse slot of said second securing member is an annular groove.

33. The invention of claim 26 wherein said second of said securing members has a central curved body, said first end of said securing member is a free end, said free end and said second end of said securing member being substantially parallel to each other, said free end being shorter than said second end, said free end and said second end spaced apart sufficiently to accommodate the muzzle of said gun therebetween, said securing member and said second base forming a muzzle receiving enclosure when said second end of said securing member is inserted in said first passageway of said second base.

34. The invention of claim 26 wherein said first of said securing members has a central curved body, said first end of said securing member is a free end, said free end and said second end of said securing member being substantially parallel to each other, said free end and said second end spaced apart barely sufficiently to accommodate the grip portion of a gunstock therebetween, said securing member and said first base forming a gun grip receiving enclosure when said second end of said securing member is inserted in said first passageway of said first base.

35. The invention of claim 26 wherein said bases have a plurality of said first passageways, one securing member is engageable with each of said first passageways.

36. The invention of claim 26 wherein a third of said bases, which is substantially identical to said first base, permanently mountable at the rear face thereof to said substantially immovable structure, said third base spaced apart from said second base a distance less than the distance between the gun grip and muzzle end of said gun to be secured, a third securing member insertable within said first passageway of said third base, a third locking member engageable with said third securing member associated with said third base, for selectively locking said third securing member to said third base, said third securing member locking said gun grip to said third base, said second securing member being of sufficient size to receive the muzzle of said gun along with said muzzle of said gun secured to said first base by said first securing member.

37. The invention of claim 36 wherein said third of said securing members has a central curved body, said first end of said third securing member is a free end, said free end and said second end of said third securing member being substantially parallel to each other, said free end and said second end spaced apart barely sufficiently to accommodate the grip portion of a gunstock therebetween, said third securing member and said third base forming a gun grip receiving enclosure when said second end of said third securing member is inserted in said first passageway of said third base.

38. The invention of claim 36 wherein said guns to be secured have fixed trigger guards thereon, the third of said securing members is an elongated pin, said first end of said elongated pin is an enlarged end being larger than the opening of said trigger guards of the gun or guns to be secured, said second end of said pin being insertable through said trigger guard and into said first passageway of said third base.

39. The invention of claim 36 wherein said body of said second securing member having an opening therethrough adjacent said second end of said body, said second of said locking members comprising a locking element interferingly insertable within said transverse opening and engageable with said opening through the body of said second securing member.

40. The invention of claim 26 wherein said bases are elongated bars, said recesses of said bars are elongated channels along the lengths of said bars.

* * * * *